US011466853B2

(12) United States Patent
Mastellari et al.

(10) Patent No.: US 11,466,853 B2
(45) Date of Patent: Oct. 11, 2022

(54) VALVE DELIVERY APPARATUS

(71) Applicant: SIT S.P.A., Padua (IT)

(72) Inventors: Luca Mastellari, Mestrino (IT); Lorenzo Zulian, Fosso (IT); Filiberto Rimondo, Saonara (IT)

(73) Assignee: SIT S.P.A., Padua (IT)

( * ) Notice: Subject to any disclaimer, the term of this patent is extended or adjusted under 35 U.S.C. 154(b) by 211 days.

(21) Appl. No.: 16/771,753

(22) PCT Filed: Dec. 10, 2018

(86) PCT No.: PCT/IT2018/050241

§ 371 (c)(1),
(2) Date: Jun. 11, 2020

(87) PCT Pub. No.: WO2019/116407

PCT Pub. Date: Jun. 20, 2019

(65) Prior Publication Data

US 2021/0071868 A1 Mar. 11, 2021

(30) Foreign Application Priority Data

Dec. 11, 2017 (IT) ..... 102017000142488
Sep. 18, 2018 (IT) ..... 102018000008661

(51) Int. Cl.
*F23D 5/16* (2006.01)
*F23N 1/00* (2006.01)

(52) U.S. Cl.
CPC ..... *F23N 1/005* (2013.01); *F23N 1/002* (2013.01); *F23N 2225/04* (2020.01); *F23N 2235/14* (2020.01); *F23N 2235/18* (2020.01)

(58) Field of Classification Search
CPC .. F23N 1/005; F23N 2235/14; F23N 2235/18; F23K 2900/05002
See application file for complete search history.

(56) References Cited

U.S. PATENT DOCUMENTS 2,297,854 A * 10/1942 Alfery ..... G05D 23/1919 137/66
3,999,932 A * 12/1976 Matthews ..... F23N 5/247 137/66
4,044,794 A * 8/1977 Matthews ..... F23N 1/007 137/66
5,379,794 A * 1/1995 Brown ..... F23N 1/005 137/75

(Continued)

FOREIGN PATENT DOCUMENTS

JP 62037614 A 2/1987
WO 2007017009 A1 2/2007
WO 2007098790 A1 9/2007

OTHER PUBLICATIONS

International Search Report and Written Opinion for PCT Appl. No. PCT/IT2018/050241, dated Mar. 20, 2019, 9 Pages.

*Primary Examiner* — Reinaldo Sanchez-Medina
(74) *Attorney, Agent, or Firm* — Maine Cernota & Rardin

(57) ABSTRACT

Apparatus to deliver gas having a delivery pipe that extends from an entrance end to a gas delivery end along which there are, one after the other, an entrance component, a pressure regulator and a flow rate regulator coordinated with respect to each other to supply on each occasion the desired quantity of gas to a burner of an apparatus fed by gas, or by a mixture of air/gas.

16 Claims, 5 Drawing Sheets

(56) References Cited

U.S. PATENT DOCUMENTS

| | | | | |
|---|---|---|---|---|
| 6,263,908 | B1 * | 7/2001 | Love | F16K 31/42 251/47 |
| 2001/0032678 | A1 | 10/2001 | Bircann et al. | |
| 2006/0207654 | A1 * | 9/2006 | Huang | G05D 16/0672 137/66 |
| 2010/0108927 | A1 * | 5/2010 | Perz | F16K 31/0696 251/129.15 |
| 2012/0153200 | A1 * | 6/2012 | Turrin | F23K 5/002 251/129.15 |
| 2012/0160186 | A1 | 6/2012 | Turrin | |

* cited by examiner

VALVE DELIVERY APPARATUS

RELATED APPLICATIONS

This application is a national phase application filed under 35 USC § 371 of PCT Application No. PCT/IT2018/050241 with an International filing date of Dec. 10, 2018, which claims priority of IT Patent Application 102017000142488, filed Dec. 11, 2017 and IT Patent Application 102018000008661, filed Sep. 18, 2018. Each of these applications is herein incorporated by reference in its entirety for all purposes.

FIELD OF THE INVENTION

The present invention concerns a gas delivery apparatus to feed a burner present in a gas-fed apparatus, or fed with an air/gas mixture.

By way of non-restrictive example, the gas-fed apparatuses discussed here can include boilers, storage water heaters, stoves, ovens, fireplaces, or other similar or comparable apparatuses.

BACKGROUND OF THE INVENTION

It is known that gas-fed apparatuses have high efficiency and hygienic combustion only when the correct composition of the air/gas mixture is maintained in the range of available thermal flow rates.

Some known gas delivery apparatuses have a pressure regulator able to define the delivery pressure of the gas exiting from the delivery pipe toward the burner of the apparatus fed by gas, or by a defined air/gas mixture.

The pressure regulators normally have a shutter element associated with an aperture and configured to cooperate with a regulation membrane connected to a regulation spring to define the pressure of the gas downstream of the aperture.

The regulators provide that by setting the contrast force of the regulation spring on the regulation membrane, and therefore on the shutter, it is possible to define the pressure of the gas downstream of the shutter.

These known solutions provide that the operation to regulate the pressure is performed by means of a mechanical calibration device, possibly commanded by a step-wise movement member, which acts on the regulation spring and defines its load.

However, making a regulation curve to obtain a hygienic combustion, by acting on the load of the regulation spring by means of a calibration device, requires an accuracy in the production of the components involved in the regulation that makes their construction complex and expensive.

This problem is emphasized in the cases of applications that use an electronic combustion control.

In fact, in such applications a high modulation field is required (the modulation field is defined as the ratio between maximum flow delivered and minimum flow delivered), and a well defined gradient of the modulation curve throughout the operating range.

Known pressure regulators do not allow to obtain a precise development of the characteristic modulation of the exiting gas as a function of the command at low flow rates, either the command intended as the applied resistive force, or the number of steps of the step-wise movement member.

It is also known that the delivery flow rate of the gas exiting from the pressure regulator is not linearly proportional to the contrast force exerted by the regulation spring on the regulation membrane.

It is also possible to use sensors to determine the combustion characteristics which, through indirect measurements, allow to verify and adapt the delivery of the exiting gas in order to allow hygienic combustion.

These sensors, however, do not allow to obtain a quick and precise regulation of the quantity of exiting gas, especially when it is necessary to deliver small quantities, since, in this latter case, the reaction times of the sensors are long and increasingly less acceptable.

In this context, the above aspects contribute to make the regulation of the quantity of gas delivered complicated and not dynamically adaptable to possible changes in gas and/or the air/gas ratio desired on each occasion.

There is therefore a need to perfect and make available a gas delivery apparatus which overcomes at least one of the technical disadvantages mentioned above.

The purpose of the present invention is to provide a gas delivery apparatus which allows to deliver, on each occasion, the precise and desired quantity of gas according to requirements, the type of gas and the air/gas ratio required on each occasion, at the same time guaranteeing high performance and hygienic combustion in a wide range of thermal flow rates.

Another purpose of the present invention to provide a gas delivery apparatus able to obtain a modulation curve with an increasing gradient at low gas-flow rates.

Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, the present invention concerns an apparatus to deliver gas having a delivery pipe that extends from an entrance end to a gas delivery end, along which there are, in series:

at least an entrance component with two electro-valves coaxial with or separate from each other, and cooperating with at least a first aperture present in the delivery pipe and held in a normally closed position by two respective holding springs, the electro-valves being able to be positioned on each occasion in an open position in relation to the action of at least an electrically powered coil associated with one or both of the electro-valves;

a pressure regulator provided with a shutter cooperating with a second aperture present in the delivery pipe and connected to a first regulation membrane able to define a regulation chamber in which the internal pressure is equal to atmospheric pressure, said first regulation membrane also being connected to a regulation spring configured to define the pressure of the gas downstream of the second aperture in relation to the compression force applied to the regulation spring by means of a mechanical calibration device.

According to possible embodiments, the pressure regulator comprises a second regulation membrane connected to the shutter and defining with the first regulation membrane a compensation chamber fluidically connected to the delivery pipe downstream of the second aperture by means of a passage channel present in the shutter.

According to possible embodiments, the mechanical calibration device comprises a movement member configured to apply a compression force on the regulation spring to define the pressure of the gas downstream of the second aperture.

In accordance with a characteristic aspect of the present invention, the apparatus to deliver gas also has a flow rate regulator, located downstream of the pressure regulator, wherein said flow rate regulator comprises:

- a fixed body mounted in the delivery pipe and having a through aperture,
- a mobile body provided with a shutter portion mating with the through aperture to define on each occasion the section of passage of the gas in relation to their reciprocal position, and
- a movement member configured to position the shutter portion at least between an open position and a partly closed position, in which respectively the through aperture is open and the through aperture is partly closed by the shutter portion.

According to possible solutions, the shutter portion comprises an elastic flap, for example a blade, positionable in relation to the through aperture of the fixed body to determine the section of passage of the gas and therefore the delivery flow rate of the latter. The elastic flap is positioned by means of a movement member.

The movement member that acts on the elastic flap can comprise a rod with a first end located in contact with the elastic flap and a second end connected to a linear actuator configured to position the rod along its own longitudinal axis.

In accordance with possible embodiments, the first end of the rod comprises a head located in contact with the elastic flap. The head is eccentric with respect to the longitudinal axis of the rod.

The movement member that acts on the elastic flap can be configured to allow the rotation of the rod around its own longitudinal axis.

The rotation of the rod, preferably driven manually in the assembly step, serves to correctly position the rod with respect to the elastic flap.

An angle can be defined between the longitudinal axis and the plane tangent to the elastic flap at the point where it is attached to the fixed body.

According to possible embodiments, the through aperture of the fixed body can have a first portion with a linear perimeter profile and a second portion with a tapered perimeter profile, wherein the first portion and the second portion are connected to each other by a connection portion with a substantially exponential perimeter profile.

According to possible embodiments, the first movement member associated with the pressure regulator and/or the second movement member associated with the flow rate regulator comprise a step motor, a linear and/or rotary actuator and another type of similar or comparable movement member.

In accordance with possible variant embodiments, the first movement member and/or the second movement member can comprise a modulating element of the electromagnetic or pressure type, or another type.

In accordance with possible solutions, the first movement member and/or the second movement member are governed by a control and command unit in order to be driven in a manner coordinated with each other to modulate the pressure of the gas exiting from the delivery end and the delivery flow rate.

The control and command unit is configured to adapt the functioning of the first and/or the second movement member in relation to the type of gas used.

According to possible embodiments, the second movement member has a shaft provided with a worm screw, and the mobile body has, along at least part of its external perimeter, a toothed sector engaging with the worm screw, said mobile body being configured to rotate around an axis of rotation orthogonal to the lying plane of the through aperture in relation to the action of the second movement member.

According to another variant embodiment, the fixed body and the mobile body can have a tubular shape, for example a cylindrical shape.

In this case, the mobile body is coaxial to the fixed body and has a through aperture that can be positioned in relation to the through aperture of the fixed body to allow the delivery of the gas.

Depending on the reciprocal position of the two through apertures the flow rate of the gas delivered is defined on each occasion.

According to this variant, the through aperture of the mobile body can be positioned with respect to the through aperture of the fixed body by means of a linear actuator, or a rotary actuator.

According to a possible variant, downstream of the delivery end an air/gas mixing device is connected, provided with a fan able to deliver the desired quantity of air, in order to obtain on exit, on each occasion, a mixture having the desired air/gas ratio.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
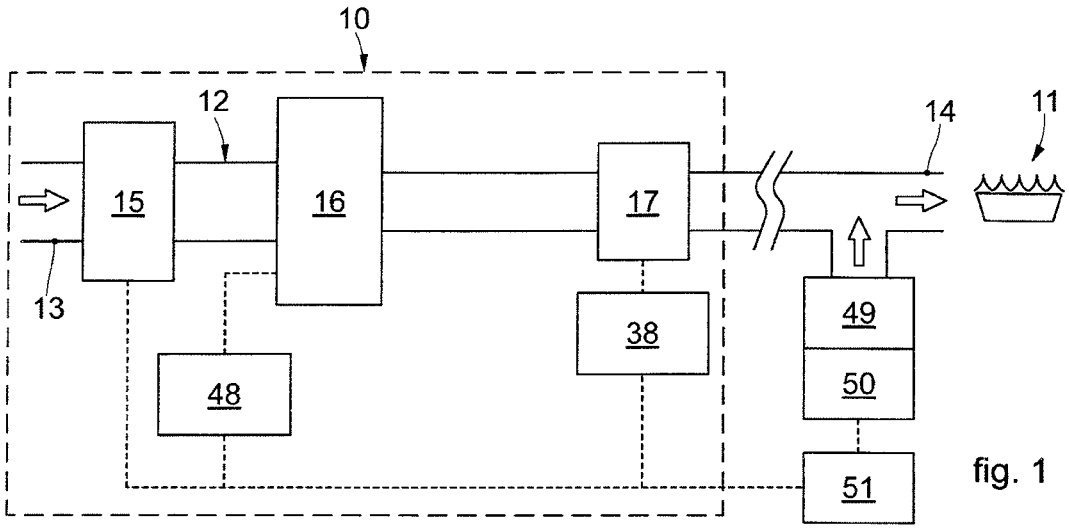
FIG. 1 schematically shows an apparatus to deliver gas according to a possible embodiment of the present invention.
Figure 2:
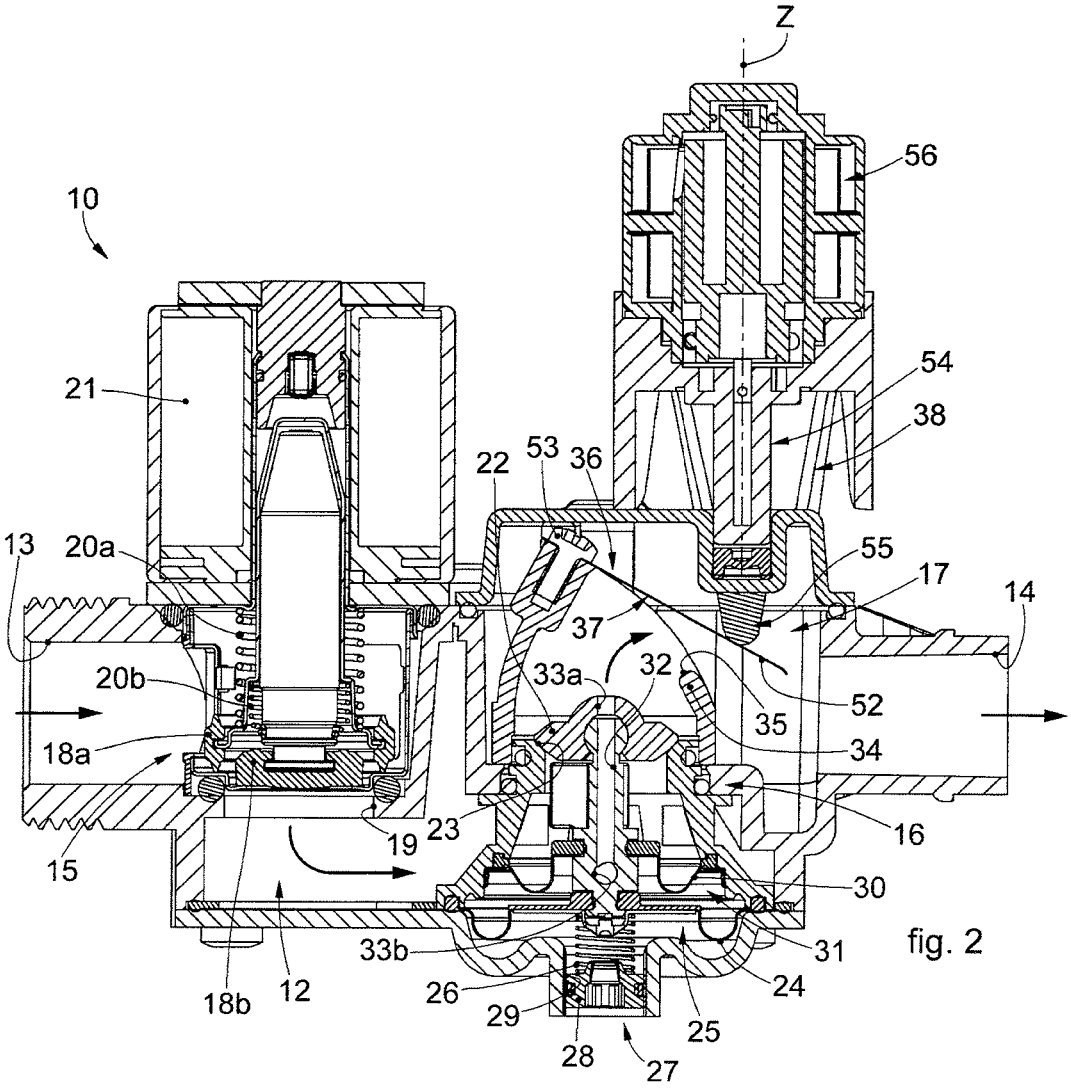
FIG. 2 is a section of an apparatus to deliver gas according to a possible embodiment.

Embodiments described here, with reference to the drawings, concern a gas delivery apparatus 10 to feed a burner 11 present in a gas-fed apparatus, or fed with an air/gas mixture.

Gas-fed apparatuses discussed here comprise boilers, storage water heaters, stoves, ovens, fireplaces, or other similar or comparable apparatuses in which there is at least one burner 11, fed with natural gas, methane, propane, or other gases, or air/gas mixtures.

The gas delivery apparatus 10 has a delivery pipe 12 which extends from an entrance end 13 to a delivery end 14 of the gas; along the delivery pipe 12 there are in series an entrance component 15, a pressure regulator 16 and a flow rate regulator 17.

According to possible embodiments, the entrance component 15 has two electro-valves 18*a* and 18*b* cooperating with at least a first aperture 19 present in the delivery pipe 12 and held in a normally closed position by two respective holding springs 20*a* and 20*b*.

Figure 3:
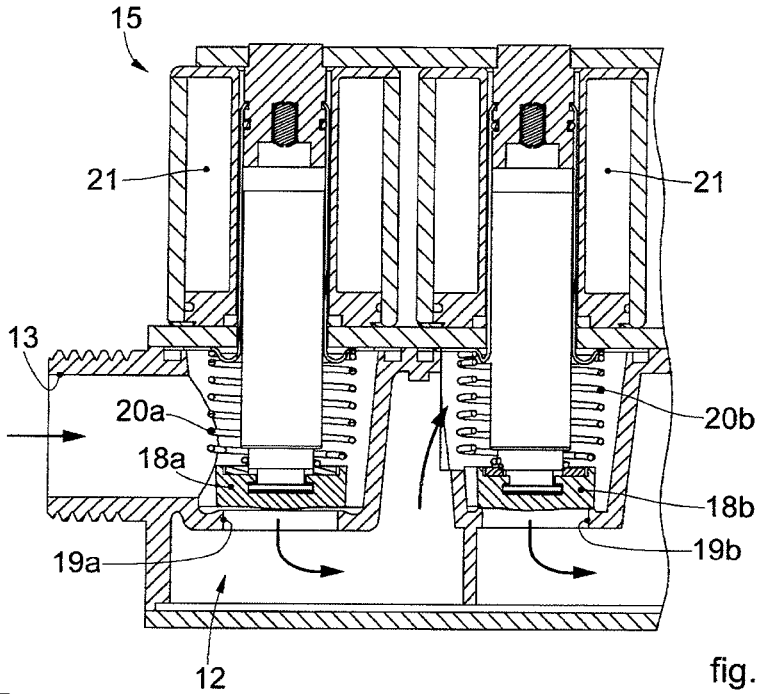
FIG. 3 is a section of a portion of an apparatus to deliver gas according to a possible embodiment.
Figure 4:
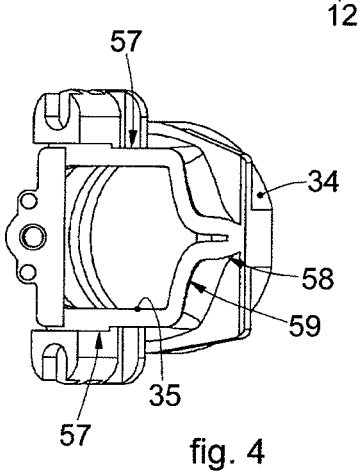
FIG. 4 is a view from above of a fixed body of a flow rate regulator of an apparatus to deliver gas.

With reference to FIG. 3, the two electro-valves 18*a* and 18*b* can be located in succession. In this case, given by way of example, the electro-valves 18*a* and 18*b* are respectively associated with an aperture 19*a* and an aperture 19*b*.

According to possible embodiments, the two electro-valves 18*a* and 18*b* can be coaxial, or separated from each other.

The electro-valves 18*a* and 18*b* are configured to be positioned on each occasion in an open position in relation to the action of at least one electrically powered coil 21.

The electrically powered coil 21 can be functionally associated with both electro-valves 18*a* and 18*b*.

According to possible variants, the entrance component 15 can comprise two electrically powered coils 21 each associated with a corresponding electro-valve 18*a* and 18*b*.

According to possible embodiments, when the coil 21 is fed, it contrasts the holding force exerted by the two holding springs 20*a* and 20*b* and positions both the electro-valves 18*a* and 18*b*, so as to allow the gas to transit through the first aperture 19.

In the case of two distinct and separate electro-valves 18*a* and 18*b*, each coil 21 contrasts, during use, the holding force exerted by the respective holding spring 20*a* and 20*b* associated with the corresponding electro-valve 18*a* and 18*b*.

The electro-valves 18*a* and 18*b* can be positioned in a common direction perpendicular to the lying plane of the first aperture 19.

The entrance component 15 performs a safety function, since, if a malfunction occurs or it is necessary to intervene on the gas delivery apparatus 10, or on the gas-fed apparatus connected thereto, it can be driven in order to stop the gas delivery promptly.

The entrance component 15 can be configured to be replaceable without altering, or replacing, the first aperture 19 of the delivery pipe 12.

This allows to use entrance components 15 having different characteristics without modifying the geometry of the delivery pipe 12 and in particular of the first aperture 19.

According to possible embodiments, the pressure regulator 16 is provided with a shutter 22 cooperating with a second aperture 23 present in the delivery pipe 12.

The shutter 22 is connected to a first regulation membrane 24 able to define a regulation chamber 25 in which the internal pressure is equal to the atmospheric pressure.

The first regulation membrane 24 is also connected to a regulation spring 26 configured to define the pressure of the gas downstream of the second aperture 23 in relation to the compression force applied to the regulation spring 26 by means of a mechanical calibration device 27.

The regulation spring 26, the compression force set by the mechanical calibration device 27 on the regulation spring 26 and the atmospheric pressure in the regulation chamber 25 contribute to define the pressure of the gas downstream of the shutter 22.

The mechanical calibration device 27 can comprise an abutment body 28 which can be attached in a removable manner on each occasion, for example by mechanical interference, inside a channel 29 of the pressure regulator 16.

Depending on the position of the abutment body 28, it is possible to define the abutment position of the regulation spring 26, and therefore the force exerted by it toward the first regulation membrane 24 and the shutter 22.

In accordance with possible embodiments, the abutment body 28 can be an Allen key, a threaded nut, or other similar or comparable element, which can be positioned, for example, by screwing/unscrewing it with a tool such as a screwdriver, or other.

According to possible embodiments, the mechanical calibration device 27 can comprise a first movement member 48, configured to apply a compression force on the regulation spring 26 to define the pressure of the gas downstream of the second aperture 23.

The first movement member 48 can comprise a servomotor, a step motor, an actuator or similar or comparable member.

According to possible embodiments, the pressure regulator 16 comprises a second regulation membrane 30 connected to the shutter 22.

The second regulation membrane 30 defines, with the first regulation membrane 24, a compensation chamber 31 fluidically connected to the delivery pipe 12 downstream of the second aperture 23 by means of a passage channel 32 present in the shutter 22.

The passage channel 32 has two apertures 33*a* and 33*b* which allow the delivery pipe 12 to be connected to the compensation chamber 31.

This configuration allows to keep the pressure of the gas downstream of the second aperture 23 constant, and also the pressure of the gas in the compensation chamber 31, due to the force defined by the compression of the regulation spring 26, independently of the entrance pressure and the fall in pressure downstream of the flow rate regulator 17.

According to one aspect of the present invention, the gas delivery apparatus 10 also has a flow rate regulator 17 located downstream of the pressure regulator 16.

The flow rate regulator 17 comprises a fixed body 34, mounted in the delivery pipe 12 and having a through aperture 35, and a mobile body 36 provided with a shutter portion 37 mating with the through aperture 35 to define on each occasion the section of passage of the gas through the through aperture 35 in relation to their reciprocal position.

The flow rate regulator 17 also comprises a second movement member 38 configured to position the shutter portion 37 at least between an open position and a partly closed position, in which respectively the through aperture 35 is open and the through aperture 35 is partly closed by the shutter portion 37.

According to possible embodiments, the shutter portion 37 of the mobile body 36 can comprise an elastic flap 52 which is positioned, on each occasion, in relation to the through aperture 35 of the fixed body 34 by means of the second movement member 38.

One end of the elastic flap 52 can be attached to the fixed body 34 by suitable attachment means 53, such as for example screws, or other.

According to possible embodiments, the second movement member 38 comprises a rod 54 having a first end 55 located in contact with the elastic flap 52 and a second end connected to a linear actuator 56.

The linear actuator 56 is configured to position the rod 54 along its longitudinal axis Z. This allows to position the elastic flap 52 in relation to the through aperture 35, so as to define the flow rate of gas delivered.

For example, the linear actuator 56 can comprise a servomotor, a step motor, a motion conversion mechanism with a linear motion, or another similar or comparable member.

The section of passage of the gas through the through aperture 35 is determined, on each occasion, by the position of the elastic flap 52 with respect to the through aperture 35, which in turn is defined by the position of the rod 54 along its longitudinal axis Z.

This embodiment not only simplifies the geometry of the flow rate regulator 17, as it comprises a limited number of components, but also allows to modulate in a controlled manner the functional relation which connects the gas flow rate Q to the position of the shutter portion 37 determined on each occasion by the second movement member 38.

Applicant has found that it is possible to obtain a well defined modulation curve of the gas flow rate Q as a function of the position of the shutter portion 37, or the elastic flap 54, defined by the second movement member 38 with an increasing gradient at low gas flow rates.

An angle $\alpha$ is defined between the longitudinal axis Z of the rod 54 and the plane tangent to the elastic flap 52 in the point where the latter is attached to the fixed body 34.

Applicant has found that as the angle $\alpha$ increases, the development of the modulation curve of the gas flow rate Q changes as a function of the command d, whether it is understood as an extension of the rod 54 along the longitudinal axis Z, or as a number of steps of the actuator 56 which drives the rod 54. See, for example, the schematic development shown in FIG. 6.

Figure 6:
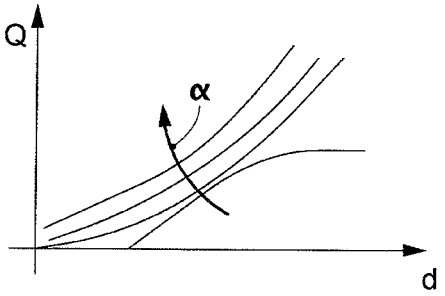
FIG. 6 schematically shows the development of the characteristic flow rate vs command and how it can be modulated at low flow rates.
Figure 7:
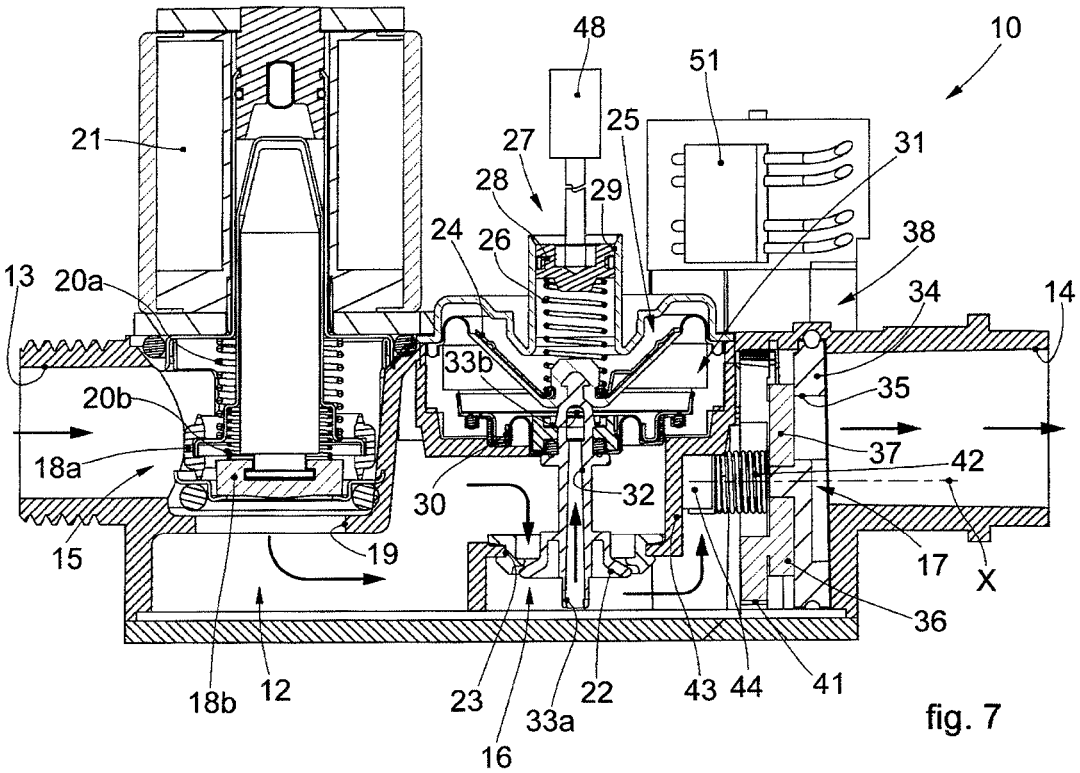
FIGS. 7 and 8 are two sections of two apparatuses to deliver gas according to possible embodiments of the present invention.
Figure 8:
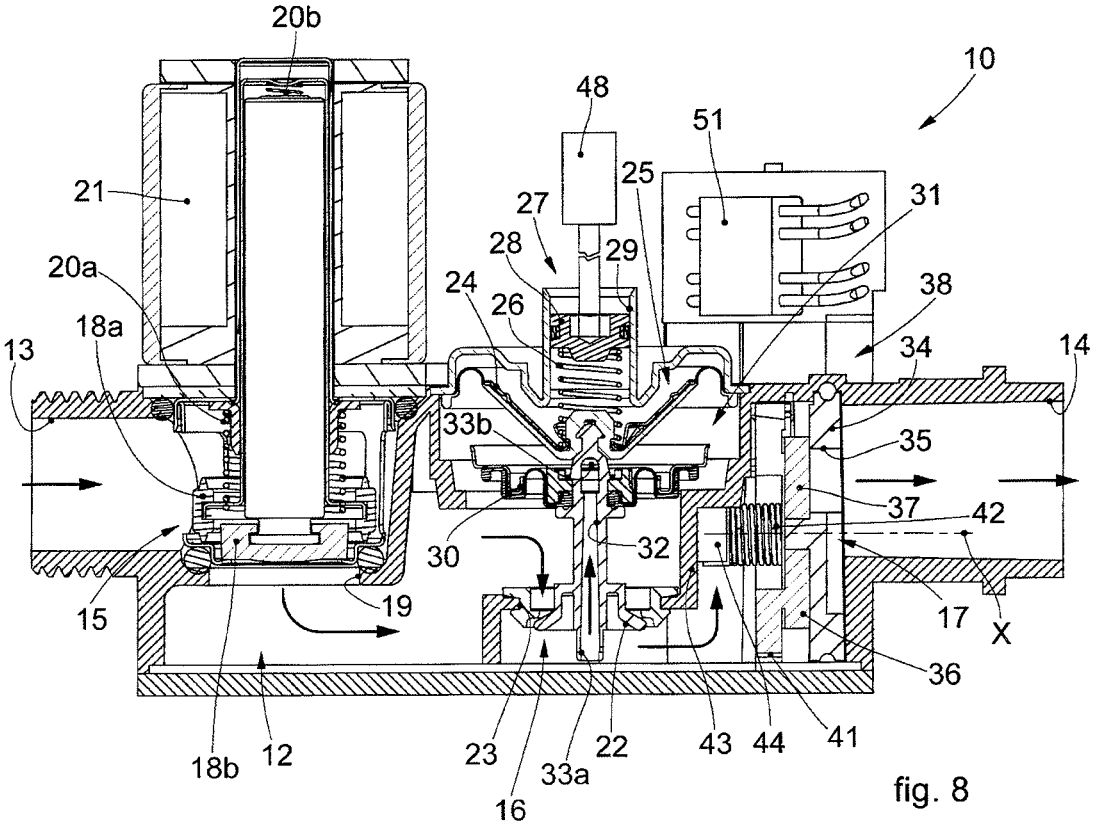

In FIG. 6, the arrow shows schematically how the modulation curve varies according to the angle $\alpha$.

Figure 5:
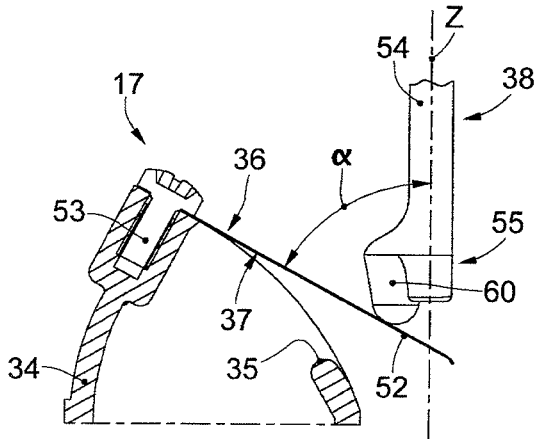
FIG. 5 is a section of a detail of a flow rate regulator according to possible embodiments.

According to possible embodiments, shown in FIG. 5, the profile of the through aperture 35 can be an arc of a circle.

Different profiles of the through aperture 35 can also be provided.

Applicant has found that by decreasing the radius of curvature of the profile of the through aperture 35, the gradient of the modulation curve of the flow rate Q increases as a function of the command d.

According to possible embodiments, the through aperture 35 of the fixed body 34 has at least a first portion 57 having a linear perimeter profile and at least a second portion 58 having a tapered perimeter profile.

The first portion 57 and the second portion 58 are connected to each other by a connection portion 59.

According to possible advantageous embodiments, the connection portion 59 has a preferably exponential perimeter profile.

Applicant has found that by passing from a connection portion 59 with a linear perimeter profile to a connection portion 59 with an exponential perimeter profile the gradient of the modulation curve of the flow rate Q increases as a function of the command d.

According to possible embodiments, the first end 55 of the rod 54 in contact with the elastic flap 52 comprises a head 60 located in contact with the elastic flap 52.

The head 60 is advantageously eccentric with respect to the longitudinal axis Z of the rod 54.

According to possible advantageous embodiments, the point of contact of the head 60 with the elastic flap 52 is eccentric with respect to the longitudinal axis Z of the rod 54.

According to some embodiments, the second movement member 38 comprises an electric motor 61, for example of the step type, provided with a drive shaft connected to the shaft 54, or defining the rod 54 itself, configured to move the latter axially in predefined positions.

According to possible embodiments, the delivery pipe 12 can be at least partly closed upward by an upper covering element 62, and the movement member 38, in the example case the electric motor 61, can be installed above it, with its own drive shaft, or the rod 54, passing through a suitable passage hole 63 made in it.

Figure 11:
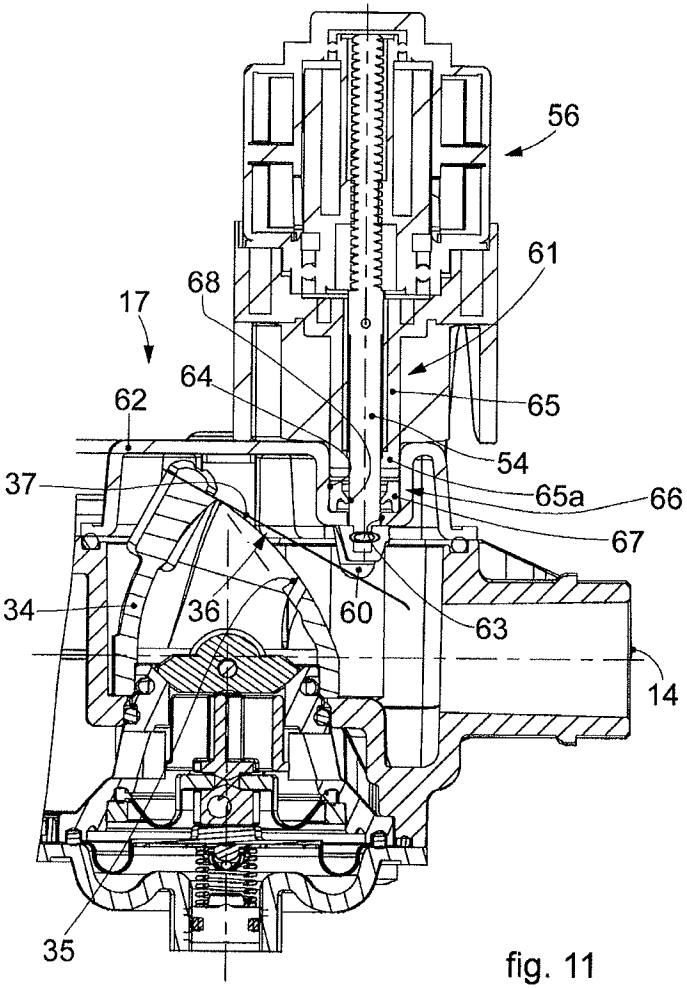
FIG. 11 is a section view of a flow rate regulator according to variant embodiments described here.

According to some embodiments, the upper covering element 62 can be shaped in such a way as to define a housing seating 64 suitable to house at least a lower portion 65*a* of a containing casing 65 of the movement member 38, so as to guarantee a stable and precise positioning thereof (FIG. 11).

Figure 12:
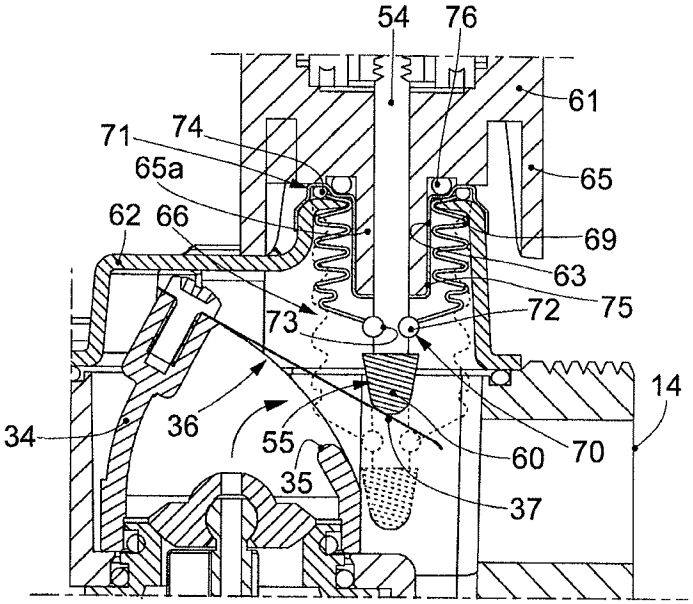
FIG. 12 is a section view of a detail of a flow rate regulator according to other embodiments described here.

According to possible variants, the lower portion 65*a* can extend inside the passage hole 63 through the upper covering element 62 (FIG. 12).

According to some embodiments, the electric motor 61 can be the gas-tight type, that is, configured to prevent gas leaks through it toward the surrounding environment, or at least keep them below the limits imposed by legislation.

According to alternative embodiments, for example described with reference to FIGS. 11-12, the electric motor 61 can be the non-gas-tight type, so as to reduce the overall costs of the flow rate regulator 17, and therefore of the apparatus 10.

According to these variants, the flow rate regulator 17 can comprise a sealing device 66 configured to guarantee the seal of the second movement member 38, preventing the gas from escaping from the delivery pipe 12 toward the external environment.

According to some embodiments, for example described with reference to FIG. 11, the sealing device 66 comprises a ring gasket 67 configured to cooperate with the rod 54, guaranteeing a radial seal of the latter.

The ring gasket 67 can comprise a sealing lip 68, also called a "lip-ring, of the single or double type, which extends toward the central portion of the ring gasket 67, so as to define a sliding seal on the rod 54.

According to other embodiments, the ring gasket 67 can be disposed inside the housing seating 64, and has a shape substantially mating with it. In this way, the lower portion 65*a* of the containing casing 65 of the motor 61 is positioned in the housing seating 64 above the ring gasket 67, thus preventing unwanted axial movements of the latter which could otherwise occur due to the sliding of the rod 54. According to possible variant embodiments, for example described with reference to FIG. 12, the sealing device 66 comprises a bellows seal 69, advantageously made of compressible and flexible material, attached to the rod 54 and configured to extend and contract as a function of the axial movement of the latter.

The bellows seal 69 is configured to completely surround the rod 54 in a radial direction.

In FIG. 12, by way of example, two possible positions of the rod 54 and of the bellows seal 64 are shown, of which a contracted position is shown in a continuous line and an extended position is shown in a dotted line.

The bellows seal 69, in the contracted position, can have a plurality of folds, folded over on themselves and collected in a pack, which tend to extend in the extended position.

According to some embodiments, the bellows seal 69 is constrained with a lower end 70 to the rod 54, in proximity to the first end 55 of the latter, and with an upper end 71 to the upper covering element 62.

According to some embodiments, the lower end 70 comprises a lower sealing ring 72 protruding toward the inside and configured to act as a radial sealing element. The rod 54 can be provided with a mating seating 73 suitable to house and hold the lower sealing ring 72.

According to some embodiments, the upper end 71 comprises an upper sealing ring 74 configured to function as an axial sealing element, which, during use, is compressed between the upper covering element 62 and the containing casing 65.

According to variant embodiments, a thin guide sleeve 75 can also be provided, shaped in such a way as to surround the lower portion 65*a* of the containing casing 65 which extends below the passage hole 23, leaving a passage gap for the rod 54, and to follow the profile of the upper covering element 62 at the upper part.

Another sealing ring 76 can also be provided between the guide sleeve 75 and the containing structure of the motor 61.

If the membrane ruptures, the interference gap between the rod 54 and the guide 75 guarantees a controlled gas leak, in order to comply with safety regulations.

Figure 9:
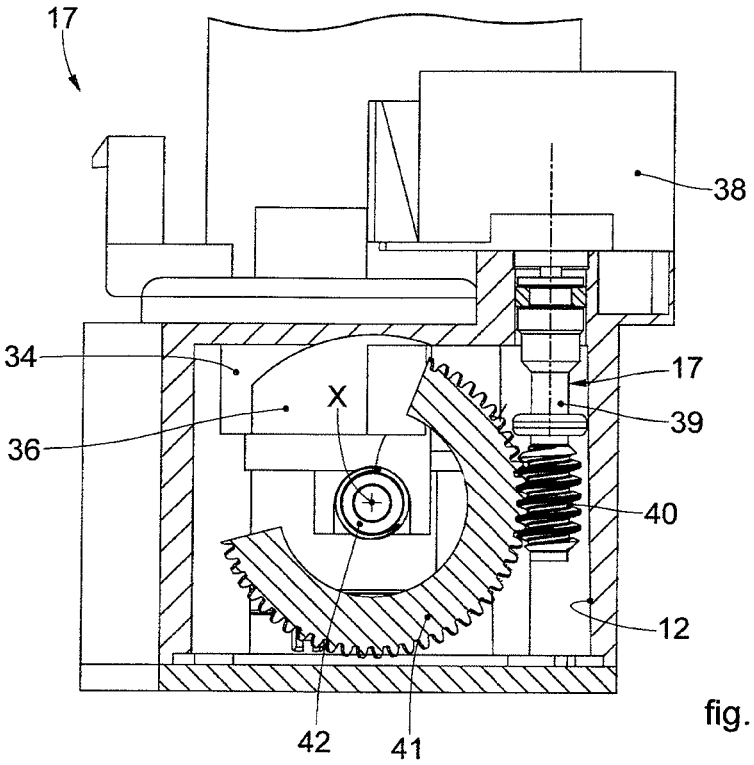
FIG. 9 is a view in section of FIG. 8.
Figure 10:
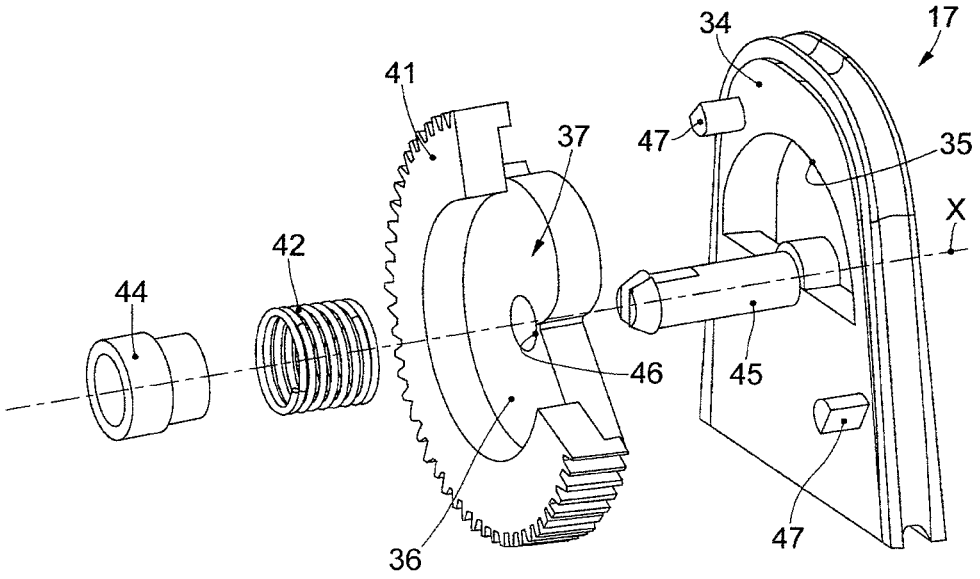
FIG. 10 is an exploded view of a flow rate regulator of an apparatus to deliver gas according to a possible embodiment of the present invention.

According to possible variant embodiments, described for example with reference to FIGS. 9 and 10, the second movement member 38 can be configured to allow the rod 54 to rotate around its longitudinal axis Z.

The rotation of the rod 54, preferably driven manually during the assembly step, serves to correctly position the rod 54 with respect to the elastic flap 52.

By rotating the rod 54 around its longitudinal axis Z, if the head 60 is present, it is possible to regulate the position of the point of contact of the head 60 with the elastic flap 52.

According to possible embodiments, the second movement member 38 can comprise a manually driven screw.

According to possible embodiments, the second movement member 38 has a shaft 39 provided with a worm screw 40, and the mobile body 36 has, along at least part of its external perimeter, a toothed sector 41 engaging with the worm screw 40.

In accordance with possible embodiments, the mobile body 36 is configured to rotate around an axis of rotation X orthogonal to the lying plane of the through aperture 35 in relation to the action of the second movement member 38.

According to a possible embodiment, the axis of rotation X is substantially perpendicular to the axis of movement of the two electro-valves 18*a* and 18*b* and/or of the shutter 22.

This configuration of the gas delivery apparatus 10 is particularly advantageous, since it has a limited bulk, it simplifies the assembly and/or maintenance operations, it also allows to contain the extension of the delivery pipe 12 and it determines lower load losses because the flow is not diverted.

Depending on the number of revolutions, the feed steps, or also the electric command signal of the second movement member 38, it is possible to define the reciprocal position of the shutter portion 37 and the through aperture 35.

This reciprocal position allows to define the flow rate according to the type of gas. By adapting the reciprocal position on each occasion according to the type of gas, it is possible to supply the desired quantity of gas precisely.

According to possible embodiments, the flow rate regulator 17 comprises an elastic thrust body 42 located in contact with the mobile body 36 and with an abutment portion 43 of the delivery pipe 12, or with an abutment body 44 located in contact with the abutment portion 43.

The elastic thrust body 42 is configured to exert a thrust on the mobile body 36 toward the fixed body 34 such as to reduce the through aperture 35 to a minimum when the shutter portion 37 is in a partly closed condition.

According to possible embodiments, the flow rate regulator 17 comprises a cylindrical body 45 attached to or forming part of the fixed body 34 inserted in a through hole 46 present in the mobile body 36 and able to define the axis of rotation X of the mobile body 36 itself.

According to a variant, the elastic thrust body 42 is inserted into the cylindrical body 45 and cooperates with it to define the thrust direction along which the elastic thrust body 42 acts.

According to possible embodiments, the fixed body 34 can have one or more protruding reference portions 47 mating with the mobile body 36, which are positioned in such a way as to define mechanical references for the positioning of the shutter portion 37.

In other words, the mobile body 36 is conformed so as not to be able to rotate further in one direction of rotation or the other when it is associated in abutment with one or the other of the protruding reference portions 47.

According to another variant embodiment, not shown, the fixed body 34 and the mobile body 36 can have a tubular shape, for example, a cylindrical shape.

In this case, the mobile body 36 is coaxial with the fixed body 34 and has a through aperture which can be positioned in relation to the through aperture 35 of the fixed body 34 to allow the delivery of the gas.

Depending on the reciprocal position of the two through apertures, the passage section, and therefore the flow rate of the delivered gas, is defined on each occasion.

According to this variant, the through aperture of the mobile body 36 can be positioned with respect to the through aperture 35 of the fixed body 34 by means of the second movement member 38 which, in this case, can comprise a linear actuator or a rotary actuator.

According to possible variants, an air/gas mixing device 49 can be disposed downstream of the delivery end 14, and is provided with a fan 50 able to deliver the desired quantity of air to obtain, on each occasion, a mixture with the desired air/gas ratio.

In accordance with possible solutions, the first movement member 48 and the second movement member 38 are governed by a control and command unit 51 to be driven in a coordinated manner with respect to each other, in order to modulate the pressure of the gas leaving the delivery end 14 and the delivery flow rate.

The control and command unit 51 can be associated with the gas-fed apparatus, for example the control and command unit 51 can be the control board of a boiler intended to perform a plurality of functions.

According to possible variants, the control and command unit 51 can be an electronic board outside the control board of the boiler.

The delivery flow rate and the pressure of the gas exiting the delivery end 14 can be defined in relation to one or more quantities selected from a group comprising the type of gas used, the position of the shutter portion 37, the pressure of the gas downstream of the second aperture 23 which, in turn, is a function of the compression force of the regulation spring 26 and of the position of the shutter 22 of the pressure regulator 16.

According to possible embodiments, the control unit 51 defines the delivery flow rate, the pressure of the gas and the quantity of air delivered by the fan 50 to obtain the desired air/gas ratio.

One of the advantages of the present invention is that, thanks to the pressure regulator 16, and in particular to the possibility of calibrating the force of the regulation spring 26, it is possible to define on each occasion the correct functional characteristic of the gas flow rate and the command signal to the second movement member 38.

In fact, based on the type of gas, it is possible to define a specific force to be applied to the regulation spring 26, which in turn defines a specific calibration curve of the functional relation for the flow of the exiting gas.

Moreover, depending on the conformation of the through aperture 35 and/or the mating shutter portion 37, it is possible to define a specific curve of the gas flow rate Q as a function of the command d.

In other words, the gas delivery apparatus 10 allows to parameterize the functional relationship between the gas flow rate and the command signal to the second movement member 38 by selecting the suitable pressure of the gas downstream of the second aperture 23.

In order to obtain the same result without the flow rate regulator 17 it would in fact be necessary to replace the regulation spring 26 on each occasion.

In other words, the present invention allows to adapt the delivery in relation to the type of gas without the need for manual intervention by the operator.

It is clear that modifications and/or additions of parts can be made to the gas delivery apparatus 10 as described heretofore, without departing from the field and scope of the present invention.

It is also clear that, although the present invention has been described with reference to some specific examples, a person of skill in the art shall certainly be able to achieve many other equivalent forms of gas delivery apparatus 10, having the characteristics as set forth in the claims and hence all coming within the field of protection defined thereby. In the following claims, the sole purpose of the references in brackets is to facilitate reading: they must not be considered as restrictive factors with regard to the field of protection claimed in the specific claims.

The invention claimed is:

1. A gas delivery apparatus configured to feed at least a burner in a gas-fed apparatus, or by a mixture of air/gas, wherein said gas delivery apparatus has a delivery pipe that extends from an entrance end to a gas delivery end, the following being present, one after the other, along said delivery pipe:

an entrance component with two electro-valves coaxial with or separate from each other, and cooperating with at least a first aperture present in said delivery pipe and held in a normally closed position by two respective holding springs, said electro-valves being able to be positioned in an open position in relation to the action of at least an electrically powered coil associated with one or both of said electro-valves, thereby allowing gas to flow to the gas-fed apparatus;

a pressure regulator provided with a shutter cooperating with a second aperture present in said delivery pipe and connected to a first regulation membrane able to define a regulation chamber in which the internal pressure is equal to atmospheric pressure, said first regulation membrane also being connected to a regulation spring configured to define the pressure of the gas downstream of said second aperture in relation to the compression force applied to said regulation spring by means of a mechanical calibration device; and a flow rate regulator comprising a fixed body fixed in said delivery pipe and with a through aperture, a mobile body provided with a shutter portion mating with said through aperture defining a passage for the gas in relation to their reciprocal position, allowing a flow rate of the gas to be modulated, and a second movement member configured to position said shutter portion in a plurality of different positions at least between an open position and a partly closed position, in which respectively said through aperture is open and said through aperture is partly closed by said shutter portion.

2. The gas delivery apparatus of claim 1, wherein said pressure regulator comprises a second regulation membrane connected to said shutter and defining with said first regulation membrane a compensation chamber fluidically connected to said delivery pipe downstream of said second aperture by means of a passage channel present in said shutter.

3. The gas delivery apparatus of claim 1, characterized in that said mechanical calibration device comprises a first movement member configured to apply a compression force on said regulation spring to define the pressure of the gas downstream of said second aperture.

4. The gas delivery apparatus of claim 1, wherein said shutter portion comprises an elastic flap positionable in relation to said through aperture by means of said second movement member, wherein said second movement member comprises a rod with a first end located in contact with said elastic flap and a second end connected to a linear actuator configured to position said rod along its own longitudinal axis.

5. The gas delivery apparatus of claim 4, wherein said first end of said rod comprises a head located in contact with said elastic flap, wherein said head is eccentric with respect to said longitudinal axis.

6. The gas delivery apparatus of claim 4, wherein, between said longitudinal axis (Z) and the plane tangent to said elastic flap, at the point of attachment of the elastic flap to said fixed body, an angle is defined.

7. The gas delivery The apparatus of claim 1, wherein said through aperture of said fixed body has at least a first portion with a linear perimeter profile and at least a second portion with a tapered perimeter profile, wherein said first portion and said second portion are connected to each other by a connection portion with an exponential perimeter profile.

8. The gas delivery apparatus of claim 3, wherein said first movement member and said second movement member are governed by a control and command unit configured to drive said first movement member and said second movement member in a manner coordinated with each other to modulate the pressure of the gas exiting and the delivery flow rate from said delivery end.

9. The gas delivery apparatus of claim 1, wherein said second movement member has a shaft provided with a worm screw, and said mobile body has, along at least part of its external perimeter, a toothed sector engaging with said worm screw, said mobile body being configured to rotate around an axis of rotation orthogonal to the lying plane of said through aperture in relation to the action of said second movement member.

10. The gas delivery apparatus of claim 1, wherein said first movement member and/or said second movement member comprise a movement member chosen from the group consisting of a servomotor, a step motor, a linear and/or rotary actuator, and a manually driven screw.

11. The gas delivery apparatus of claim 1, wherein said flow rate regulator comprises a sealing device configured to guarantee the sealing of the second movement member, preventing the gas from leaking out from the supply duct toward the external environment.

12. The gas delivery apparatus of claim 11, wherein said second movement member comprises a rod and said sealing device comprises a ring gasket configured to cooperate with said rod, guaranteeing a radial sealing of the latter.

13. The gas delivery apparatus of claim 12, wherein said delivery pipe is at least partially closed upward by an upper covering element shaped so as to define a housing seating suitable to house at least a lower portion of a containing casing of said second movement member, and said ring gasket is disposed inside said housing seating between said covering element and said containing casing.

14. The gas delivery The apparatus of claim 11, wherein said second movement member comprises a rod and said sealing device comprises a bellows gasket made of compressible and flexible material, constrained with a lower end to said rod and with an upper end to an upper covering element of said delivery pipe and configured to extend and contract as a function of the axial movement of said rod.

15. The gas delivery apparatus of claim 14, wherein said lower end comprises a lower sealing ring projecting inward, configured to act as a radial sealing element, and said rod is provided a seating suitable to house and hold said lower sealing ring.

16. The gas delivery apparatus of claim 14, wherein said upper end comprises an upper sealing ring configured to act as an axial seal, which, during use, is compressed between said upper covering element and a containing casing of said second movement member.

* * * * *